US006087922A

United States Patent [19]

Smith

[11] Patent Number: 6,087,922

[45] Date of Patent: Jul. 11, 2000

[54] FOLDED FOIL TRANSFORMER CONSTRUCTION

[75] Inventor: David A. Smith, Cumnor Hill, United Kingdom

[73] Assignee: Astec International Limited, The Hong Kong Special Administrative Region of the People's Republic of China

[21] Appl. No.: 09/034,628

[22] Filed: Mar. 4, 1998

[51] Int. Cl.[7] ..... H01F 27/28

[52] U.S. Cl. ..... 336/223; 336/232; 336/200

[58] Field of Search ..... 336/232, 223, 336/225, 200

[56] References Cited

U.S. PATENT DOCUMENTS

| | | | |
|---|---|---|---|
| 2,378,884 | 6/1945 | Seifert | 336/61 |
| 4,395,693 | 7/1983 | Marinescu | 336/223 |
| 4,538,132 | 8/1985 | Hiyama et al. | 336/221 |
| 4,959,630 | 9/1990 | Yerman et al. | 336/83 |
| 5,010,314 | 4/1991 | Estrov | 336/198 |
| 5,017,902 | 5/1991 | Yerman et al. | 336/83 |
| 5,034,717 | 7/1991 | Shinkai | 336/223 |
| 5,084,958 | 2/1992 | Yerman et al. | 29/606 |
| 5,126,715 | 6/1992 | Yerman et al. | 336/183 |
| 5,175,525 | 12/1992 | Smith | 336/83 |
| 5,179,365 | 1/1993 | Raggi | 336/65 |
| 5,274,904 | 1/1994 | Proise | 336/223 |
| 5,276,421 | 1/1994 | Boitard | 336/180 |
| 5,291,173 | 3/1994 | Yerman et al. | 336/183 |
| 5,381,124 | 1/1995 | Roshen | 336/200 |
| 5,473,302 | 12/1995 | Terlop | 336/183 |
| 5,844,461 | 12/1998 | Faulk et al. | 336/206 |

FOREIGN PATENT DOCUMENTS

| | | | |
|---|---|---|---|
| 1 489 053 | 5/1969 | Germany | 336/223 |

OTHER PUBLICATIONS

Radcliffe, Flat Winding Transformer, IBM Technical Disclosure Bulletin, vol. 22 No. 9, Feb. 1980.

*Primary Examiner*—Michael L. Gellner
*Assistant Examiner*—Anh Mai
*Attorney, Agent, or Firm*—Coudert Brothers

[57] ABSTRACT

An improved low profile transformer is disclosed. The transformer has desirable characteristics for switch mode power supplies such as minimum high frequency resistance, improved coupling of primary and secondary windings, and reduced eddy current losses. The transformer has a primary winding comprised of an insulated conducting foil that is folded into a staircase-shaped winding. One or more secondary winding segments comprised of U-shaped conducting sheets are interleaved with the primary winding to form a minimally separated primary and secondary winding. The windings are substantially surrounded by an E-shaped magnetic core to facilitate the magnetic coupling of the windings.

20 Claims, 6 Drawing Sheets

FOLDED FOIL TRANSFORMER CONSTRUCTION

FIELD OF THE INVENTION

The present invention relates to electrical transformers, and more particularly to transformers for use with switch mode power supplies.

BACKGROUND OF THE INVENTION

One common type of electrical power converter that produces a regulated output voltage is a switch mode power supply or a switched supply. Conventional switch mode power supplies commonly include a power transformer and one or more power switches for alternately coupling a DC voltage across a primary winding of the power transformer, thereby generating a series of voltage pulses across one or more secondary windings of the power transformer. These pulses are then rectified and filtered to provide one or more output DC voltages.

The size, cost, and electrical performance of conventional transformers are key limitations of switch mode power supply designs. An ideal transformer for switch mode power supplies would be compact (low profile); would efficiently transfer energy from the primary windings to the secondary windings; would have minimal leakage inductance; and would be manufacturable.

Conventional transformers are generally manufactured by winding a primary coil of insulated wire on a bobbin, while a secondary coil, also of insulated wire, is wound on another bobbin. The transformer core typically consists of two segments that can be attached together. The two attached segments form a hollow section, or winding window, in which the transformer coils are situated. The transformer is typically assembled by arranging the two bobbins concentrically in the winding window of the segments of a transformer core and then attaching the segments of the transformer together around the bobbins.

It is desirable that transformers for switch mode power supplies be of minimal size, both in terms of cross-sectional area and in terms of winding height. A fundamental limitation on transformer performance results from Faraday's law. According to Faraday's law, the induced voltage across each secondary winding turn of a transformer is proportional to the time rate of change of the total magnetic flux crossing the secondary winding turn. The transformer size can be reduced by decreasing the number of winding turns or reducing the cross-sectional area of the transformer. However, if the number of winding turns and the area of each winding turn is decreased, then the magnetic flux density swing and the frequency of operation must increase in order to maintain a constant induced voltage across the secondary winding. Transformer core losses increase rapidly with magnetic flux density. Eddy current losses increase with the square of the magnetic flux density. Hysteresis losses also obey an exponential relationship, typically increasing as the magnetic flux density raised by an exponent in the range of 1.8 to 2.5, depending upon the core material. Consequently, the peak magnetic flux density in the transformer core is typically limited to less than 1 Tesla in conventional transformer designs to limit the heating and loss of efficiency caused by eddy current and hysteresis losses.

Increasing the switching rate, or frequency, is one common technique used to decrease the size of transformers used for switch mode power supplies. However, the efficiency of transformers degrades at high frequency (e.g., frequencies on the order of 1 MHZ) because of increased resistive losses in the primary and secondary windings. Classical electromagnetic theory teaches that at high frequency the current distribution in a wire decreases exponentially with a characteristic length, or skin depth, from the surface. The skin depth varies inversely as the square root of the frequency and the conductivity of a metal. For example, at a frequency of 1 MHZ, the skin depth decreases to 66 $\mu$m, such that only a small annulus of a wire conducts. The effective cross-sectional area for current flow thus decreases dramatically at high frequency, leading to a corresponding increase in resistance of the primary and secondary windings. Moreover, the problem of increased resistive losses in the secondary windings at high frequency is exacerbated when magnetic field strengths are high, because proximity effects further limit the effective cross-seclional area of the secondary windings.

Another limitation to high frequency operation of a low-profile transformer is leakage inductance. The leakage inductance occurs because not all of the of the magnetic flux generated by the primary winding is coupled by the core to the secondary winding. Some of the magnetic flux generated by the primary winding does not intersect the secondary winding but instead passes through the air space around the sides of the primary and secondary windings. In the equivalent circuit model of a transformer this leakage flux is modeled as a corresponding parasitic leakage inductance that must also be driven by the primary current but which does not couple power to the secondary winding. The transformer leakage inductance thus has the effect of impeding the flow of power from the primary winding to the secondary winding. As the switching frequency is increased, the deleterious effect of the leakage inductance increases. The leakage inductance can be reduced by spacing the primary and secondary windings as close to each other as possible, which has the effect of increasing the relative fraction of magnetic flux coupled to the secondary winding while reducing the relative fraction of leakage flux passing through the air space. Alternating the primary and secondary winding turns, what is commonly known in the art as interleaving, can also aid in bringing the primary and secondary windings close to each other, resulting in reduced leakage inductance.

Another limitation to high frequency operation of low-profile transformer is eddy current losses in the windings. The magnetic field in the air space between the windings is created by the currents flowing in both the primary and secondary windings. At high frequencies, the magnetic field caused by these current flows creates eddy currents in the windings, leading to undesirable losses. However, if the primary and secondary winding are interleaved, then there can be a substantial canceling of the magnetic field that creates these eddy current losses, leading to improved performance.

International safety standards impose additional limitations on transformer design, further exacerbating the above-described problem of miniaturizing a transformer while maintaining strong coupling between primary and secondary windings. International safety standards exist for "creepage"; "clearance"; and minimum insulation thicknesses. "Creepage" is defined as the shortest distance between two conductive parts (or from a conductive part to ground) as measured along the surface of the insulation. "Clearance" is defined as the shortest distance between two conductive parts (or between a conducting part and ground) as measured through air. For transformers used in typical switch mode power supplies, the minimum creepage distances established by international safety standards is at least 4 mm. International safety standards also require that the primary and secondary windings be separated by either 3 layers of insulation or a single layer greater than 0.4 mm thick. The protective insulation layers should also not be mechanically stressed. For a given winding topology, the insulation and creepage requirements imposed by international safety standards increases the minimum separation between primary turns; reduces the maximum number of primary turns for a given winding height; and increases the separation between primary and secondary windings. Consequently, international safety standards exacerbate the problem of achieving a very low-profile design with strong coupling between the primary and secondary windings.

Several approaches in the prior art exist for solving some of the above identified problems, although none is a completely satisfactory solution to achieve a low profile transformer consistent with switch-mode applications. For example, the prior art describes changes in winding topology to minimize eddy currents in the windings in conventional transformers with wound-wire bobbins. Changes in transformer topology can beneficially alter the magnetic field distribution, resulting in a more uniform magnetic field strength distribution. In particular, by interleaving the primary and secondary windings, the peak magnetic field strength is reduced in the air space between windings. However, an extremely low profile interleaved transformer design for switch mode power supply applications is not practical with conventional winding approaches because safety insulation requirements impose large interwinding distances, leading to poor coupling of primary and secondary windings. Even variations on conventional winding schemes suffer from the same problem. For example, the approach of U.S. Pat. No. 5,473,302 (entitled "Narrow Profile Transformer Having Interleaved Windings And Cooling Passage") describes a narrow profile transformer in which the primary and secondary windings consist of interleaved spirals comprised of insulated primary and secondary winding wires. However, such an approach would result in high resistance losses for high frequency operation because conventional wires are used for the windings. Additionally, this design is unsuitable for switch mode power supply applications. The coupling between primary and secondary windings will be poor because of the large physical separation between primary and secondary winding wires imposed by international safety requirements.

The prior art also describes low profile transformers in which the secondary winding is replaced with at least one stamped conductive foil sheet. Such an approach is described in U.S. Pat. No. 5,175,525 (entitled "Low Profile Transformer"). The primary winding consists of an encapsulated wire winding. The secondary foil windings, also encapsulated, are arranged coaxially with the primary winding. This approach has the advantage of reducing the high frequency resistance of the secondary winding since the current can flow in a broad sheet in the secondary winding. However, the coupling between the primary and secondary windings, while high because of the coaxial arrangement, is degraded by the large separation between windings necessitated by the individual encapsulation of each winding. Moreover, the high frequency resistance of the primary winding will be larger than ideal for applications where a large diameter primary winding wire is typically used. For example, a primary winding designed for a 30 V input voltage might comprise 3 turns of AWG22 magnet copper wire that has a wire diameter of 0.64 mm, which is much greater than the skin depth of copper at a switch-mode frequency of 500 kHz. Additionally, since the design is not interleaved, the eddy current and hysteresis losses will be high.

The prior art also describes low profile transformer designs in which all of the wire windings are replaced by completely planar windings. For example, in the approach of U.S. Pat. No. 5,179,365 (entitled "Multiple Turn Low Profile Magnetic Component Using Sheet Windings") conventional wire windings are replaced with copper sheets each stamped into the shape of a circular annulus, with each annulus replacing one turn of wire. This has the advantage that the high-frequency resistance of the windings is reduced, since the current in each winding flows in a broad cross-sectional area across the annulus instead of only the short circumferential skin depth of a conventional wire. Also, in principle, it is possible to interleave primary and secondary winding sheets with this approach. However, while many annular sheets of copper can be combined to create a "sandwich" of windings, there are many complications. First, each winding sheet much be connected to other sheets with appropriate pins and connectors for mechanical support and to create the required electrical connections, e.g., an n-turn primary must connect n-sheet windings. Second, mechanical considerations limit how thin a sheet of copper can be with this technique. The copper thickness must be thick enough to provide mechanical rigidity, which will tend to be much thicker than the optimum conductor thickness. Third, if such a design was used in a switch mode power supply, additional layers of insulation would have to be incorporated in order to meet international standards for creepage, clearance, and insulation. The resulting transformer would be complicated to manufacture and have a larger than ideal separation between the windings, resulting in a poor coupling of the primary and secondary windings.

In another low profile transformer approach, planar windings are created on printed circuit boards. In the approach described in U.S. Pat. No. 5,010,314 (entitled "Low-Profile Planar Transformer For Use In Off-Line Switching Power Supplies"), primary winding turns are patterned on two or more printed circuit boards, and secondary winding turns on one or more printed circuit boards. A compact transformer can be created by stacking several such printed circuit boards together in a sandwich configuration, with each winding separated by insulating layers composed of the printed circuit board itself and additional insulation (if required to meet safety standards) applied to the surface of each patterned winding. However, this approach suffers from numerous drawbacks. First, the thickness of conducting metals that can be patterned or plated has practical limitations such that it is difficult to pattern conducting layers comparable to the skin depth (at common switch mode power supply frequencies) in order to obtain minimum resistance losses in each planar winding. For example, as previously discussed, at a frequency of 1 MHZ the skin depth of copper is 66 $\mu$m. In order for planar winding turns to have minimum resistance (and since two sides of the surface conduct), a film thickness in excess of 132 $\mu$m is required, a thickness that is difficult to conveniently pattern with existing techniques. Second, it is necessary to electrically connect different layers of the sandwich in order to create an electrically continuous primary or secondary "coil" from multiple layers. Via hole connections or additional external connecting rods must be used, increasing the manufacturing problems of this approach. Third, in order to satisfy international standards on creepage, the inner-most winding must be separated at least 4 mm from the central core, resulting in a larger than ideal transformer area. Fourth, the coupling of the primary and secondary windings may be degraded if the thickness of the printed circuit boards, required insulation, and necessary spacers creates a larger than ideal separation between layers.

Another approach to fabricating low profile transformers with planar winding turns consists of folding a patterned sheet upon itself to convert a two-dimensional pattern into a set of coaxial coil-like windings. This approach is described in U.S. Pat. Nos. 4,959,630 (entitled "High-frequency transformer"), 5,084,958 (entitled "Method Of Making Conductive Film Magnetic Components"), and 5,017,902 (entitled "Conductive Film Magnetic Components"). Conducting paths with a repeating (periodic) serpentine shape are patterned on both top and bottom sides of a planar but flexible film. The patterned film is then folded upon itself along each half-period of the serpentine. The accordion-like folding after each half-period creates a series of spatially concentric half coils, with, for example, each full primary winding traversing a 180 degree turn on one segment of the film and completing another 180 degree turn on another, now accordion folded, segment of the flexible film. Because both sides of the flexible film are patterned with serpentine shaped conductors, a series of concentric primary and secondary windings are formed. However, this approach also suffers from several drawbacks. First, there are practical limits on the thickness of the patterned conductor, both in terms of the patterning and the folding process, making it difficult to achieve optimum conductor thickness. Second, there is the cost and difficulty of fabricating such flexible circuits and in enclosing the windings in suitable insulation that meets international safety standards. It is difficult to satisfy international safety requirements because there are creepage paths from the winding turns to the transformer core and between the primary and the secondary winding. Third, there are mechanical problems with this approach, because folding the film back upon itself creates mechanical stresses at the sharp "accordion" edges of the film, which increases the likelihood of insulation breakdown. The problem of mechanical stress at the accordion folds is exacerbated because the folds are located inside of the assembled transformer and thus subject to the mechanical stresses resulting from the transformer assembly process in addition to those stresses associated with the thermal cycling of the transformer. Fourth, additional contacts or solder joints are needed to connect the coils to external contacts. Although each patterned serpentine has two ends, once it is accordion folded, one end of each coil will be folded under another layer with only a narrow cross section of the conductor exposed at the edge of the fold. Consequently, to make electrical contact to each folded-under end of a coil will require soldering or bonding contacts at the edge of the folds, exacerbating the manufacturing and reliability problems.

None of the existing approaches for low profile transformers is a fully satisfactory solution to the problem of designing low profile transformers for switch mode power supplies. All of them have manufacturing problems in addition to design problems that can severely degrade their performance for switch mode power supply applications. No known prior art transformer design possesses all of the desired characteristics for a low-profile design: 1) minimally spaced interleaved primary and secondary windings to achieve a high coupling factor, low eddy currents, and low leakage inductance; 2) wide planar windings of optimum thickness (greater than the skin depth) to minimize high-frequency resistance; and 3) a manufacturable design consistent with international safety standards. Consequently, there is a need for an improved transformer design that is compact (low profile); high efficiency (minimal resistive losses and core losses); is consistent with international safety requirements for creepage, clearance, and insulation; and that can be economically fabricated.

SUMMARY OF THE INVENTION

Broadly stated, the present invention is a low profile transformer comprising: a primary winding formed from a conductive ribbon and having a generally staircase-shaped structure, the staircase-shaped structure having long planar ribbon segments but progressing up in steps at corner-turns; a secondary winding having at least one continuous conductive ribbon secondary winding segment substantially interleaved with the long planar ribbon segments of the primary winding; means for electrically insulating the primary and secondary windings; and a magnetic transformer core substantially surrounding the interleaved windings around the long planar ribbon segments. The present invention also describes a method of fabricating such a low-profile transformer, the method comprising the steps of: folding a foil a plurality of times to form a staircase-shaped primary winding; forming secondary winding segments from generally U-shaped sheets of copper; means for electrically insulating the primary winding and the secondary winding segments; interleaving the primary winding and the secondary winding segments; and installing a transformer core around the interleaved primary and secondary windings.

One object of this invention is a low profile transformer with reduced eddy current losses in the windings as a result of an interleaved design.

Another object of this invention is a low profile transformer that provides strong coupling between the primary and secondary windings and low leakage inductance because of the minimal separation between the interleaved primary and secondary windings.

Still another object of this invention is a low profile transformer design with reduced high-frequency resistance because the ribbon-like windings provide a substantially larger circumferential conducting area than conventional wires at high frequency.

Yet another object of this invention is a low profile transformer design of minimal winding height, with the total height of the interleaved windings in the transformer core approaching the sum of the thicknesses of the individual conducting sheet thicknesses and the insulating layers coating them.

Still yet another object of this invention is a low profile transformer design that has minimal mechanical stress, since the folds of the primary windings are located outside of the transformer core and are cushioned and supported by insulating layers.

A further object of this invention is a method of economically manufacturing the previously described low profile transformer.

These and other objects of the present invention will become apparent from the attached drawings and the following detailed description of the invention.

BRIEF DESCRIPTION OF THE DRAWINGS

FIG. 7B is cross-sectional side view generally taken along the line 7B—7B of FIG. 7A, showing the interleaved primary and secondary windings inside of the assembled transformer along with a side profile of the primary winding and secondary winding segments extending outside of the transformer core.

DETAILED DESCRIPTION OF THE INVENTION AND PREFERRED EMBODIMENTS

Figure 1:
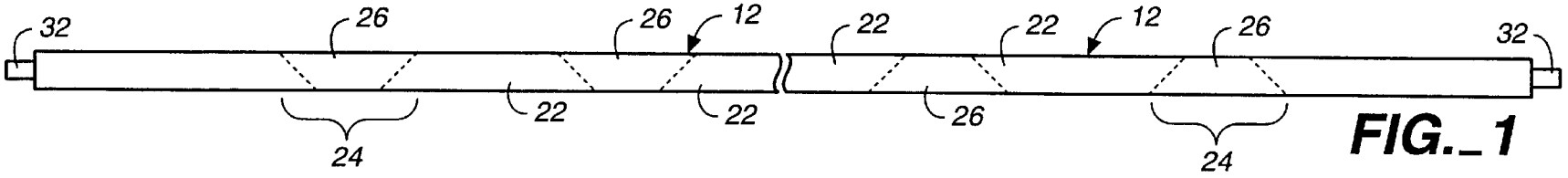
FIG. 1 shows a top view of a length of copper foil wrapped in insulation.

The present invention comprises a low profile transformer that combines the advantages of planar windings for reduced high frequency resistance and minimally separated primary and secondary windings for improved coupling between the primary and secondary windings. As shown in FIG. 1, the primary winding is formed from a length of foil 12 preferably wrapped in insulation. The precise thickness of the foil 12 will depend upon a variety of factors, such as mechanical considerations, but should be greater than the skin depth of the foil conductor at the switch mode power supply's switching frequency. The foil 12 may consist of any high conductivity metal, metal alloy, or composite metal layers, but in the preferred embodiment copper is used because of its excellent conductivity and low cost. The length of the foil 12 required will depend upon the winding pattern and the number of turns desired. The optimum width 13 of the foil 12 will depend upon a variety of factors such as the manufacturability of transformers utilizing narrow foil strips and the variation in magnetic coupling with foil width. In one preferred embodiment, the foil 12 is a copper foil 0.2 mm thick, 4 mm wide, and 200 mm long.

Insulation between adjacent layers of foil 12 is provided in a preferred embodiment of the present invention. In one embodiment, a variety of flexible insulation materials may be used as an insulation coating for foil 12 as long as the insulation is suitable for switch mode power supply transformers. In one preferred embodiment, the insulation thickness is chosen such that the primary winding in the transformer satisfies international creepage requirements without the need for additional insulation or spacing between the primary winding and the transformer core. Examples of suitable insulation materials include a coating of enamel, a covering of plastic, insulation tape, and heatshrink tubing. The insulation may also provide additional mechanical support for the conductive ribbon. Consequently, the selection of the type and thickness of insulation coating to be used includes both electrical and mechanical considerations. A third consideration in the choice of insulation type and thickness is the applicability of relevant international safety standards. As described below, in the assembled transformer the separation between primary and secondary windings in the transformer core will approach that of the insulation thicknesses separating the windings. Consequently, it is desirable to select the insulation type and thicknesses of the primary and secondary windings such that, in the assembled transformer, the separation between primary and secondary windings can approach the minimum separation possible under international safety requirements.

Figure 2:
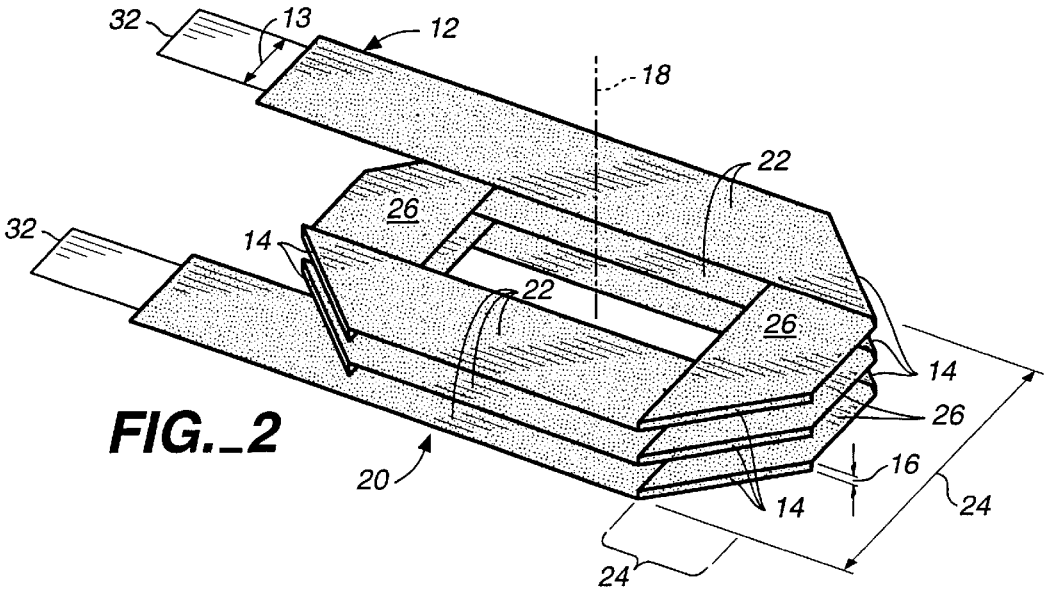
FIG. 2 shows a perspective view of a length of insulated copper foil after it has been folded a plurality of times to form a staircase structure.

As shown in FIG. 2, a staircase-shaped primary winding is formed by folding the foil 12 to create a plurality of corner turns 14. The folding of corner turns 14 is repeated such that the folding process creates a staircase-like structure rising around a common central axis 18 of a rectangular-shaped stairwell. The resultant staircase-shaped folded foil primary winding 20 is comprised of long planar segments 22 in between step segments 24, with each step segment 24 consisting of one short planar segment 26 and two corner turns 14. As shown in FIG. 2, in one embodiment the staircase-shaped primary winding has a generally rectangular-shape with long planar segments 22, short planar segments 26, and corner turns 14 defining a rectangular-shaped stairwell. However, while FIG. 2 shows one preferred embodiment, the relative lengths of the long planar segments 22 and short planar segments 26 may be varied considerably from what is shown in FIG. 2. For example, the relative lengths of the planar segments may be varied to form rectangular stairwells with both high aspect ratios and low aspect ratios (e.g., a square, which is a rectangle with four equal sides). After each fold of a corner turn 14, there is an increase in height 16 at least equal to the thickness of foil 12, which is a consequence of the fact that the foil 12 is folded back on top of itself at each corner turn 14.

The corner turns 14 are preferably made by creasing the foil 12 at a forty-five degree angle with respect to the long axis of the foil 12. The folding process can be accomplished with a variety of mechanical techniques. As is well known in origami, paper airplane construction, cardboard box construction, and other related paper-folding crafts, semi-flexible strips fold relatively naturally and with only minimal stress along a forty-five degree crease. A corner turn 14 formed by creasing a semi-flexible strip at a forty-five degree angle has the minimal crease-length possible for a folded turn. A thin foil of a ductile metal like copper, particularly one that it is only a small fraction of a millimeter thick, can be readily folded. The insulation coating on the foil can be chosen to be of an appropriate type and thickness to be flexible enough to be readily folded at a forty-five degree angle with the foil 12. A wide variety of mechanical techniques are thus possible to fold the foil 12.

Figure 3:
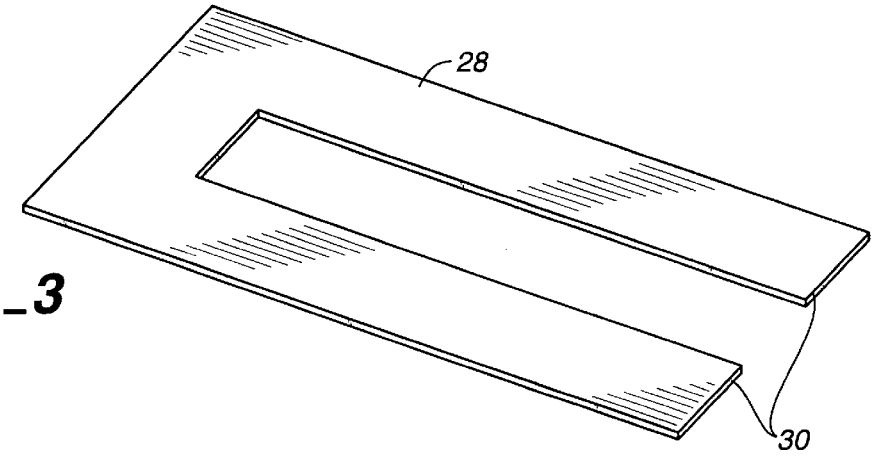
FIG. 3 shows a perspective view of a U-shaped secondary winding.

As shown in FIG. 3, in a preferred embodiment of the present invention, the secondary winding is composed of secondary winding segments 28. Each secondary winding segment 28 preferably comprises a single generally U-shaped conductive sheet. The U-shaped secondary winding segments 28 are shaped to be interleaved with the primary winding 20. However, while one shape for the secondary winding segments 28 is shown in FIG. 3, other patterns consistent with interleaving a secondary winding between adjacent steps in the foil 12 without obstructing the stairwell are also within the scope of the present invention. The secondary winding of the assembled transformer can be comprised of only one secondary winding segment 28. However, if a plurality of secondary winding segments are utilized, external electrical connections, as described below, can be made to connect each of the secondary winding segments 28 into one secondary winding.

The techniques for calculating the magnetomotive force (mmf) in a planar interleaved structure are well known to those skilled in the art, but it is well known that interleaving primary and secondary windings leads to an mmf distribution that reduces leakage inductance and core losses. The techniques used to calculate the optimum number, shape, and relative position of interleaved secondary winding segments 28 for a given primary winding 20 configuration are well known to those skilled in the art.

Although several possible techniques exist to fabricate the secondary winding segments 28, one preferred embodiment comprises the stamping of U-shaped secondary winding segments 28 out of a copper sheet. These U-shaped secondary winding segments 28 are then de-burred, coated to protect against oxidation, and coated with insulation, as required. For example, the secondary winding segments 28 may be insulated with a chemical coating, insulation tape, or paper insulators. This fabrication technique is relatively low cost, consistent with interleaving, and has the advantage that secondary windings fabricated from thin sheets of copper are consistent with both low DC (zero frequency) resistance and with a minimum high frequency resistance. While the above described insulation means used to insulate the secondary winding segments 28 are consistent with a low-cost transformer, any insulation coating consistent with switch-mode power supply transformer operation may be used, such as a thick coating of enamel or plastic. The choice of insulation type and thickness used for the secondary winding segments 28 depends, in part, on the insulation type and thicknesses coating the primary winding 20. Many variations in insulation type and thickness are possible such that the assembled transformer satisfies international safety standards. Additionally, while one technique to manufacture U-shaped secondary winding segments 28 has been described, other techniques for fabricating U-shaped secondary winding segments, such as coating a sheet of copper foil with insulation and then stamping the foil into a U-shape, are also obvious to those skilled in the art.

Figure 4:
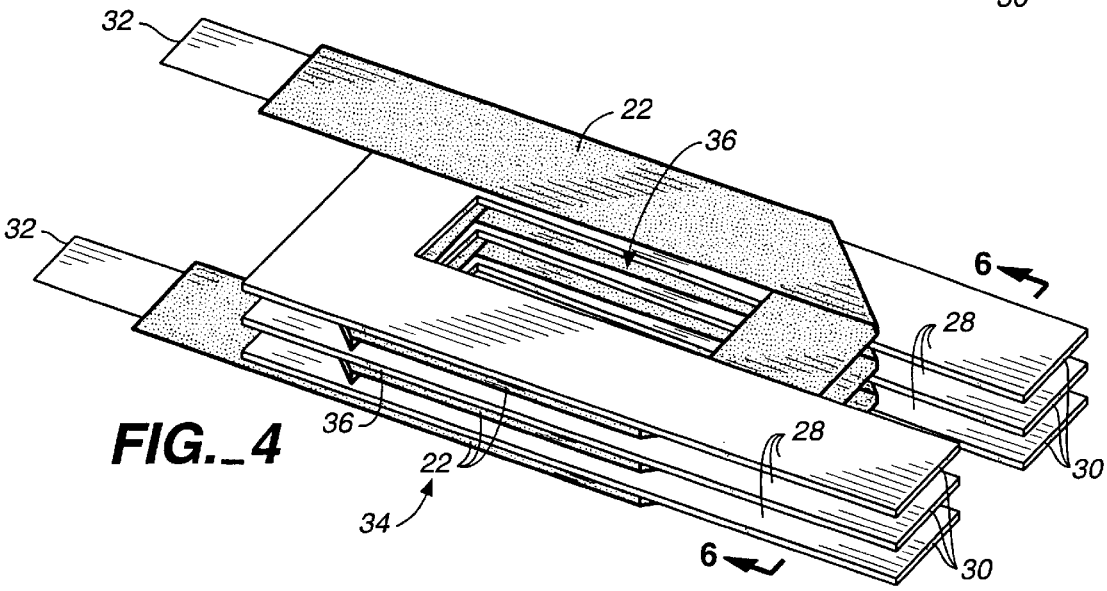
FIG. 4 shows a perspective view of interleaved primary and secondary windings.

As shown in FIG. 4, secondary winding segments 28 are preferably positioned adjacent to long planar segments 22, thus creating a structure in which each secondary winding segment 28 is interleaved with the staircase-shaped folded foil primary winding 20 resulting in a staircase shaped interleaved structure 34 having interleaved long planar segments 36. The ends 30 of the branches of the U-shaped secondary winding segments 28 extend outside of the staircase-like primary winding 20. Additionally, two uninsulated ends 32 of the folded foil 12 extend outside of the staircase-shaped interleaved structure 34. With reference to FIG. 4, note that there is an angle at which the secondary winding segments 28 can be inserted into the staircase shaped primary winding 20 such that there is a substantial overlap between the arm-segments of the U-shaped secondary winding segments 28 and the long planar segments 22 of the primary winding 20 along interleaved long planar segments 36.

Figure 5:
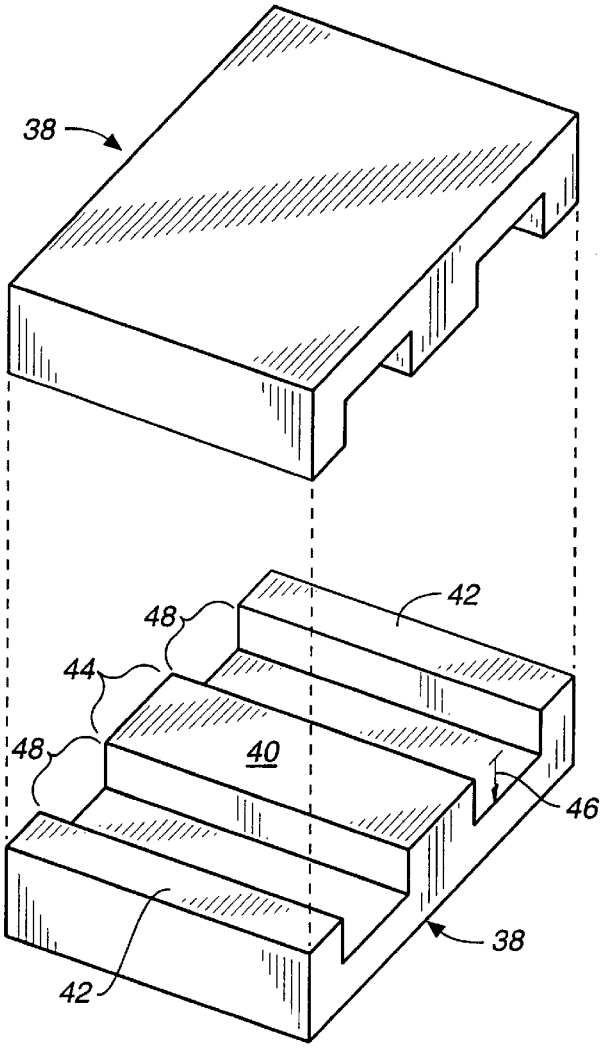
FIG. 5 shows a perspective view of two E-shaped transformer core sections.

A transformer core is installed that substantially surrounds the interleaved long planar segments 36 in order to maximize the magnetic coupling between the interleaved long planar segments 36. In one preferred embodiment, the transformer core consists of two sections, each of which has an E-shaped cross-section. As shown in FIG. 5, two E-shaped transformer core sections 38 are used to provide magnetic coupling between primary winding 20 and secondary winding segments 28. The dimensions of the E-shaped core sections 38 are chosen so that the two E-shaped sections mate around the central portion of interleaved long planar segments 36 without pressing down upon the corner turns 14. The E-shaped core sections have a length approximately the same as the stairwell and have a central segment 40 and outer edge segments 42. The width 44 of the central segment of one E-shaped section 38 is approximately equal to the stairwell width. The height 46 of the central segment is approximately one half of the stairwell height. The width of the trough 48 separating the central and outer segments of the E-shaped core is approximately equal to the width 13 of foil 12.

Figure 6:
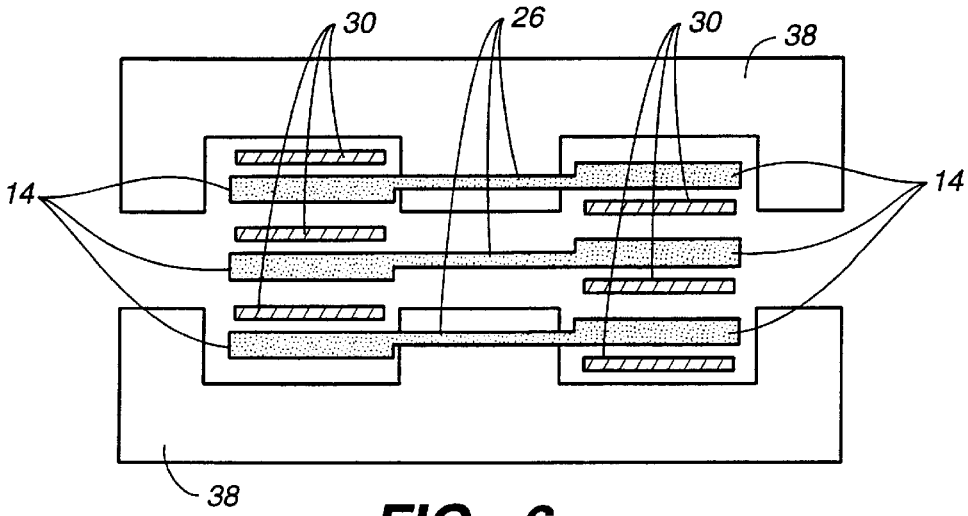
FIG. 6 shows a front view of two E-shaped transformer cores mated around the interleaved primary and secondary windings.

As shown in FIG. 6, two E-shaped transformer cores 38 are installed around the interleaved long planar segments 36 of the interleaved windings 34. Such an E-shaped transformer core consistent with the preferred embodiment is part number 42216-EC produced by Magnetics, of Butler, Pa. 16003. The central segments 40 of the cores 38 are interposed in the stairwell of the interleaved windings whereas the outermost segments 42 are mated around the staircase. The folded turns 14, the uninsulated sections of the insulated foil 32, and the ends 30 of each secondary winding 28 preferably extend outside of the installed E-shaped cores 38. The two E-shaped core sections 38 are then squeezed together and attached, as shown in the front view of FIG. 7A. In addition to facilitating mechanical rigidity of the internal components, squeezing together the transformer core sections brings the primary and secondary windings into close contact, minimizing the separation between primary and secondary windings. As shown in the cross-sectional view of FIG. 7B, in the assembled transformer the interleaved long planar segments 36 are compressed into a minimally separated sandwich region 50 of interleaved layers. The separation distance between the primary and secondary windings in the minimally separated sandwich region 50 can approach that of the applied insulation layers, which can be selected to correspond to the minimum thicknesses that satisfies international safety requirements.

The analytical techniques used to calculate the coupling of planar primary and secondary windings are well known to those skilled in the art. However, it is well known that the coupling is a strong function of interwinding separation. Consequently, the coupling of the primary and secondary windings is optimized by bringing the long planar segments 22 of the primary winding 20 and the secondary winding segments 28 into the minimally separated sandwich configuration 50.

Figure 7B:
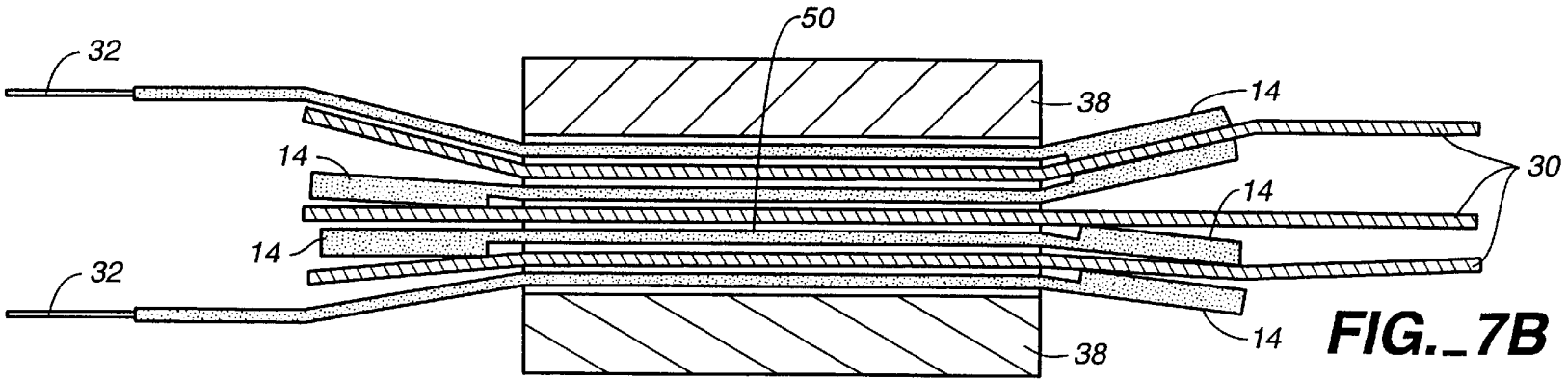
FIGS. 7A and 7B are front and side views, respectively, of the assembled transformer.
Figure 7A:
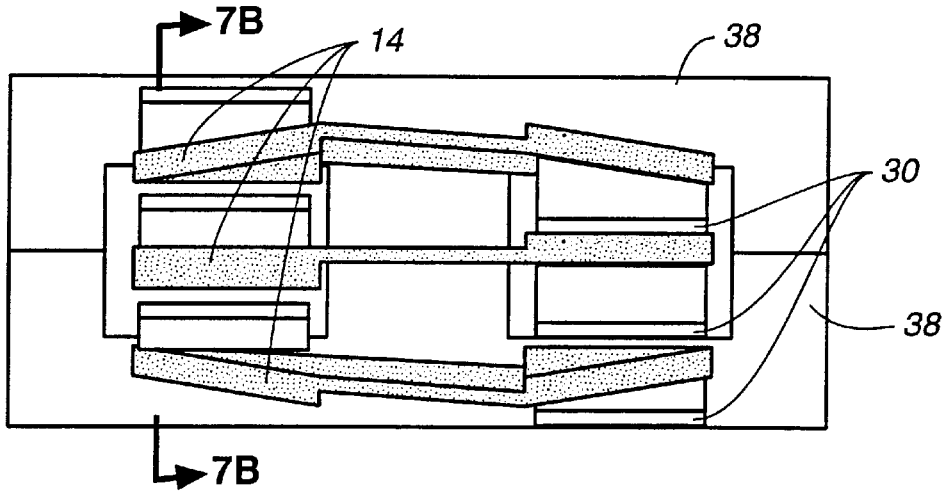

An important aspect of the present invention is that the folded corner turns 14 are situated outside of the transformer core. This permits the interleaved layers in the transformer core to be brought into their closest possible contact. Referring to FIG. 1, each folded corner turn 14, adds an additional height 16. If the corner turns were located inside the transformer core the interleaved layers would have to be more widely spaced apart. Locating the corner turns outside of the transformer core allows the additional height 16 created by the corner turns to be accommodated, enabling a minimally separated sandwich region 50 of primary and secondary windings to be formed inside the transformer core, as shown in FIG. 7B. An additional advantage of placing the folds of the corner turns 14 outside of the transformer core is that it reduces the mechanical stress placed upon the corner turns 14.

If a plurality of secondary winding segments 28 are used, they can be electrically connected in series or parallel by making appropriate electrical connections to the ends 30 of each secondary winding. Connecting together several secondary winding segments 28 in series permits them to function as a single multiple-turn secondary winding leading to a higher induced voltage compared with a single secondary winding segment 28. Connecting together a plurality of secondary winding segments 28 in parallel results in no increase in induced voltage or total current. However, the effective resistance of the secondary winding is reduced by connecting a plurality of secondary winding segments in parallel, increasing transformer efficiency.

The present invention is distinguishable from the prior art on several grounds. First, the present invention has a staircase-shaped primary winding formed from a continuous conductive ribbon, making the structure highly manufacturable. Even though there is some stress created by the folding process, the mechanical stress on the folded corners is minimized by 1) folding the foil along a natural 45 degree crease angle; 2) placing the corners outside of the transformer core; and 3) selecting appropriate insulation to cushion and protect the folded corners. The present invention achieves the advantages of planar windings for reduced high frequency resistance without the need for additional mechanical support and does not require complicated electrical connections to interconnect planar layers. Moreover, the present invention achieves an interleaved planar winding structure with very little waste of materials.

Additionally, the present invention is also distinguishable because of its superior electrical performance compared with prior art low profile transformers. The interleaved staircase structure is consistent with near optimum coupling of primary and secondary windings and with low hysteresis and eddy current losses. In the assembled transformer, the interleaved secondary windings are separated from the primary windings by only the minimum insulation thickness required by international safety standards, leading to superior magnetic coupling. Additionally, since copper foil is used in the primary windings and copper sheets in the secondary windings, the high frequency resistance will be minimized. For example, the 0.2 mm thick copper foil used in the preferred embodiment is substantially thicker than the skin depth of copper for switching frequencies on the order of 1 MHZ.

Figure 8:
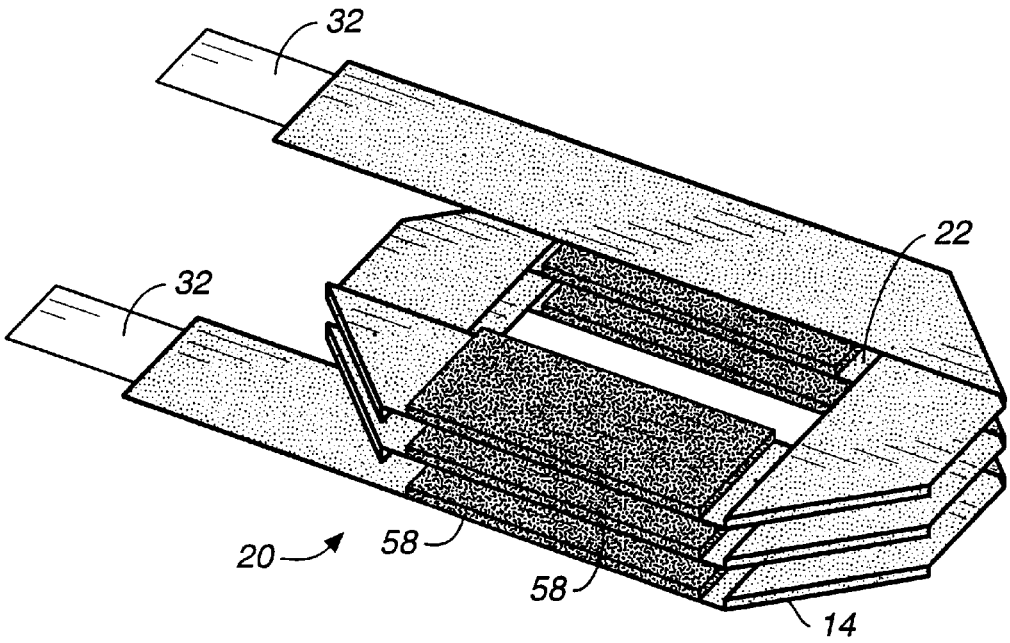
FIG. 8 shows a perspective view of a length of insulated copper foil after it has been folded a plurality of times to form a staircase structure and additional layers of insulation have been inserted in between overlapping ribbon layers.

It will also be understood by those skilled in the art that many variations on the technique used to insulate the windings are consistent with satisfying relevant international safety standards. In particular, several means could be used to reduce the increased height 16 at the corner turns, which consists primarily of the thickness of the insulation coating the foil and only secondarily on the thickness of the extremely thin foil. For example, instead of coating the foil 12 used to fabricate the primary winding with a single uniform thickness of insulation, the foil could be coated, before folding, with thicker layers of insulation in those areas that will become the long planar ribbon segments in the folded primary winding. This would reduce the increased height 16 at each folded corner turn 14 while still maintaining a thick layer of insulation in the sandwich regions 50. Similarly, a layer of insulating material might be applied to the staircase-shaped primary winding 20 after folding by such means as dipping or spraying on a uniform thickness of insulation on the folded structure, resulting in a substantial decrease in increased height 16. Also, another technique to reduce the increased height 16 is to apply a relatively thin layer of insulation to the foil 12 used to form the primary winding and a thicker layer of insulation to the secondary winding segments 28 in order to reduce the increased height 16 while still satisfying international safety standards. Additionally, insulated layers could be physically inserted between the winding layers to provide part of the required electrical insulation. For example, as shown in FIG. 8, after the primary winding is folded, sections of insulating spacing layers 58 could be inserted between overlapping long planar segments 22 or in between the corner turns 14. Moreover, a combination of the above techniques could be used to minimize the insulation cost or to reduce the stress on the corner turns.

Figure 9:
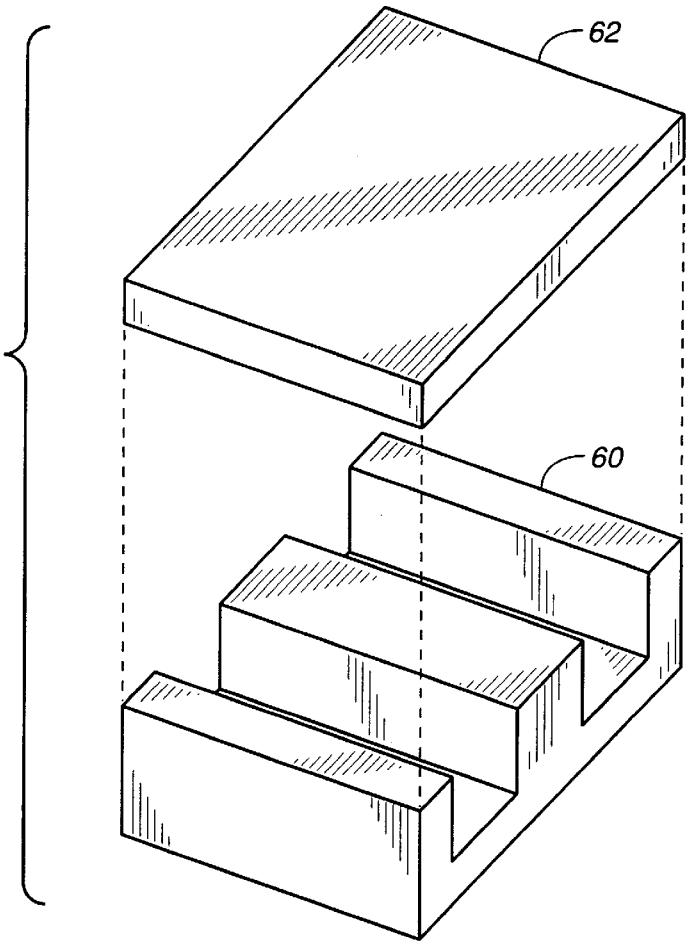
FIG. 9 shows a perspective view of one E-shaped transformer core section and a corresponding rectangular-shaped core section dimensioned to mate with it.

It will also be understood by those skilled in the art that a variety of transformer core shapes are consistent with strong magnetic coupling. For example, as shown in, FIG. 9, instead of two E-shaped transformer cores, the core may consist of one E-shaped section 60 inserted around the interleaved long planar segments 36 and capped by a second rectangular-shaped core section 62.

Additionally, although only one folded foil primary transformer fabrication process has been described to create a staircase-shaped primary winding, it will be understood by those skilled in the art that variations on this fabrication technique are possible. For example, the fabrication technique to form a staircase-shaped primary winding could be modified to include the use of stamping, soldering, thermocompression, or other techniques known to those skilled in the art in order to form one or more thin metal layers or foils into a desired staircase configuration.

Figure 10:
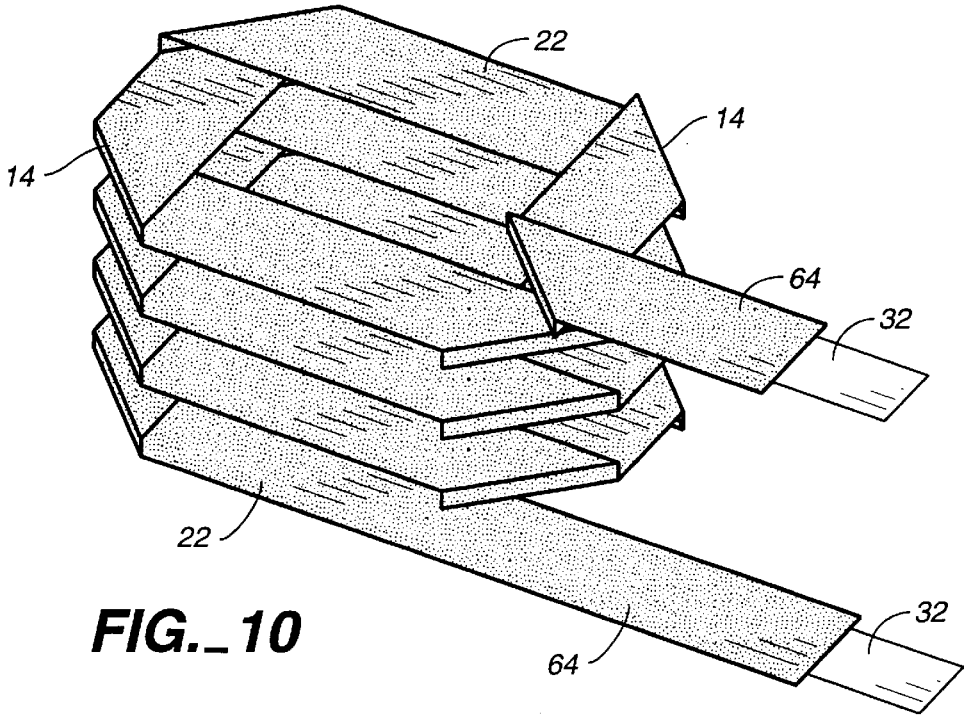
FIG. 10 shows a perspective view of primary winding formed from an insulated copper foil after it has been folded a plurality of times but with the direction of the final folds altered such that the end leads overlap with one another.

Additionally, while one sequence of folding operations has been described in detail, variations of the folding process are also within the scope of the present invention. For example, at each corner turn 14, the foil can be creased at either of two forty five degree angles with respect to the long axis of the foil 12, creating two possible directions for the corner turn 14. Additionally, at each corner turn 14 the foil 12 may be either folded on top of itself, creating a step up, or folded under itself, creating a step down. The fabrication technique may be altered in order to change the spatial arrangement of the two ends 32 of the foil 12. As shown in FIG. 10, variations on the folding process are possible in which the crease angle and folding direction of some of the corner turns 14 are selected such that the end sections 64 of the folded foil 12 near the exposed foil leads 32 exiting the primary winding 20 overlap. Overlapping the end sections 64 of the foil 12 reduces the high frequency resistive losses compared to folding the foil such that the end sections 64 are arranged side-by-side. In a pair of conductors carrying high-frequency current in opposite directions, the current tends to flow in the part of the conductors closest to each other. If the two end sections 64 of the primary winding 20 are arranged side-by-side the high-frequency currents will tend to flow only in a narrow region where the two segments are closest together, leading to increased resistive losses. By overlapping the end sections 64 the current will tend to flow throughout the entire overlapped lead area.

Figure 11:
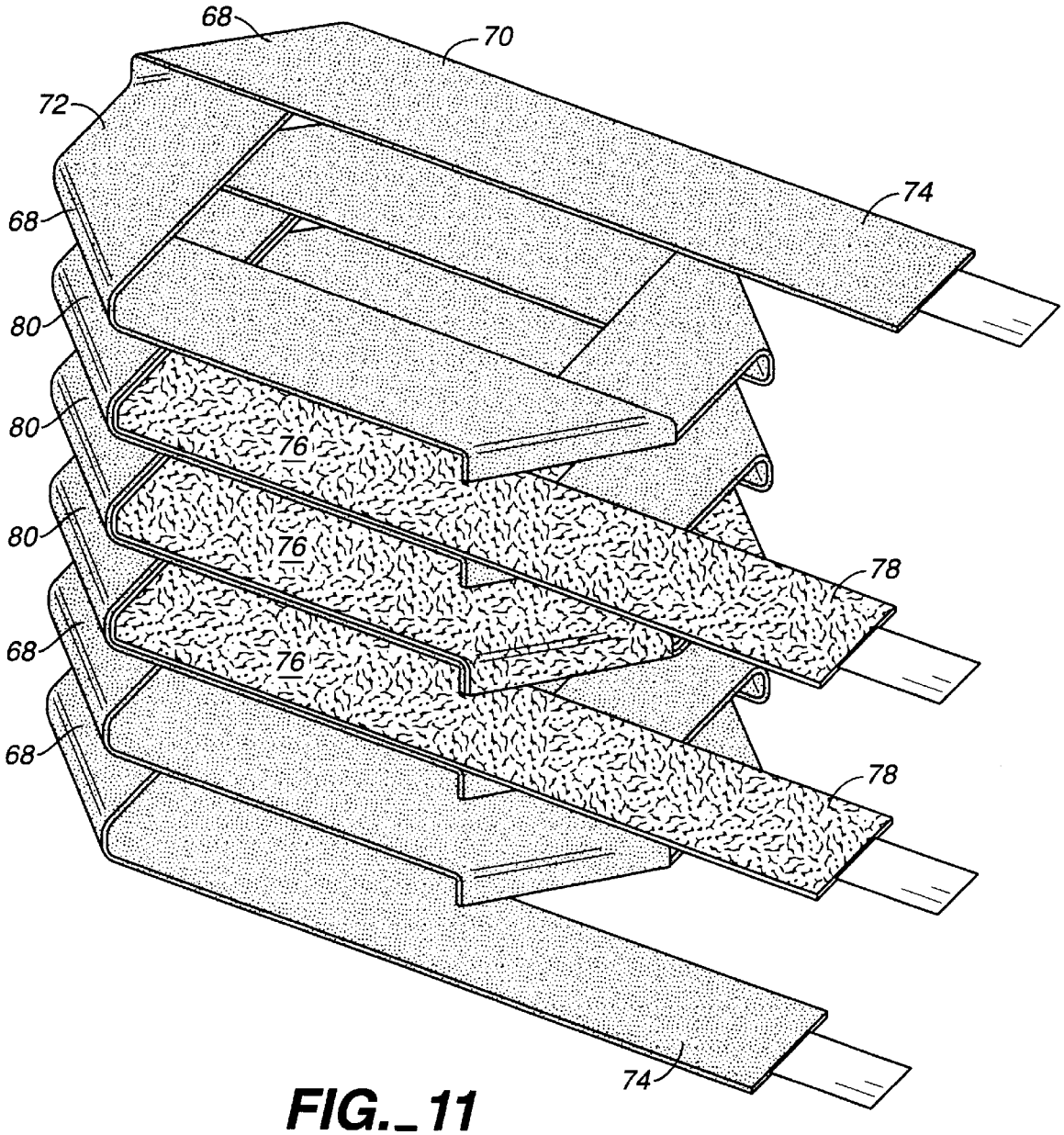
FIG. 11 shows a perspective view of an interleaved primary and secondary winding formed by overlapping and folding two ribbons of insulated foil.

While one technique to describe the fabrication of the secondary windings has been described in detail, other techniques to fabricate the secondary windings are within the scope of the present invention. The secondary windings could also be fabricated from stamped foils or other techniques known to those skilled in the art. Additionally, the secondary winding could also be formed simultaneously with the primary winding by folding two insulated foil segments simultaneously. A folded foil secondary winding would have the advantage that a secondary winding with several winding turns could be fabricated without the need to externally connect together a plurality of secondary winding segments 28. As shown in FIG. 11 an interleaved primary and secondary winding can be formed by folding a primary winding foil 74 with a secondary winding foil 78. As shown in FIG. 11 the interleaved windings will have interleaved corner turns 80 and interleaved planar sections 76 in which the two foils are folded overlapping one another. However, the primary and secondary winding do not have to have the same number of winding turns. As shown in FIG. 11 for the case of a secondary winding with fewer winding turns than the primary winding, there may also be single foil corner turns 68 and single foil planar sections 70, 72 where the primary winding foil 74 and the secondary winding foil 78 are not interleaved.

While the present invention has been particularly described with respect to the illustrated embodiments, it will be appreciated that various alterations, modifications, and adaptations may be made based on the present disclosure, and are intended to be within the scope of the present invention. While the invention has been described in connection with what is presently considered to be the most practical and preferred embodiments, it is to be understood that the present invention is not limited to the disclosed embodiments but, to the contrary, is intended to cover various modifications and equivalent arrangements that are within the scope of the appended claims.

What is claimed is:

1. A low-profile electrical transformer comprising:

a) a primary winding comprising a continuous conducting ribbon having a continuous coating of electrical insulation between a first end region and a second end region, said primary winding having a plurality of planar ribbon segments and corner turns, said primary winding forming a staircase-shaped structure having one step at each corner turn of said primary winding, said primary winding defining a rectangular-shaped stairwell;

b) a secondary winding comprising at least one secondary winding segment, each said secondary winding segment comprised of a continuous conducting ribbon interleaved between said planar ribbon segments of said primary winding, said primary winding and said at least one secondary winding segment forming a sandwich region along said planar ribbon segments; and c) a magnetic core having at least two magnetic core sections shaped to couple magnetic flux between said primary and said secondary winding and positioned to surround said sandwich region of said primary and secondary windings;

wherein said magnetic core is shaped to selectively compress said sandwich region exclusive of said corner turns so as to reduce separation between said primary winding and said secondary winding in said sandwich region.

2. The electrical transformer of claim 1 wherein said primary winding is formed by coating said conductive ribbon with said layer of electrical insulation along its entire length between said first and said second end regions of said ribbon and folding said conductive ribbon to form said corner turns, each said corner turn of said conductive ribbon formed by folding said ribbon along a forty-five degree angle crease with respect to the long axis of said ribbon.

3. The electrical transformer of claim 2 wherein said secondary winding comprises a continuous length of a second conductive ribbon having first and second end regions, said second conductive ribbon folded a plurality of times to form a second staircase-shaped structure having one step at each corner turn of said rectangular shaped stairwell, each said fold of said second conductive ribbon formed by creasing said second ribbon at a forty-five degree angle with respect to the long axis of said second foil.

4. The electrical transformer of claim 2 wherein the separation distance between a primary winding planar ribbon segment and an interleaved secondary winding segment inside said magnetic core is about equal to the thickness of said insulation layer coating of said primary winding.

5. The electrical transformer of claim 2 wherein said at least one secondary winding segment is coated with a second layer of insulation and the separation distance between a primary winding planar ribbon segment and an interleaved secondary winding segment inside said magnetic core is about equal to the thickness of said first insulation layer coating of said primary winding and said second insulation layer coating of said secondary winding.

6. The electrical transformer of claim 1 wherein the magnetic core is a low-profile double-E transformer core comprising two individual E-shaped cross-section core sections attached together so as to substantially surround said sandwich regions along said planar ribbon segments.

7. The electrical transformer of claim 1 wherein the magnetic core is comprised of one E-shaped cross-section core section and one rectangular cross-section core attached together so as to substantially surround said sandwich regions along said planar ribbon segments.

8. The electrical transformer of claim 1 wherein said at least one secondary winding segment is comprised of a U-shaped planar conductive layer.

9. The electrical transformer of claim 1 comprising electrically insulating spacing layers disposed between said primary winding and said secondary winding.

10. The electrical transformer of claim 1 comprising a plurality of said secondary winding segments, wherein said secondary winding segments are connected in series to form a multiple turn secondary winding.

11. The electrical transformer of claim 1 comprising a plurality of said secondary winding segments wherein said secondary windings are connected in parallel such that the effective electrical resistance of the secondary winding is decreased.

12. A method of fabricating a low profile electrical transformer comprising the steps of:

a) providing a conductive foil ribbon coated in a continuous layer of electrical insulation between first and second ends;

b) forming a primary winding from said conductive foil ribbon by folding said conductive foil ribbon a plurality of times by creasing the foil ribbon at a forty-five degree angle with respect to the long axis of the foil ribbon thereby forming a series of folded corner turns connecting planar ribbon segments, the primary winding forming a staircase-shaped structure rising up in steps along a common axis around a rectangular-shaped stairwell formed by the planar ribbon segments;

c) forming a U-shaped secondary winding from a continuous, planar conducting ribbon winding segment, said U-shaped secondary winding including two arm segments and a connecting segment connecting said arm segments;

d) interleaving said secondary winding with said primary winding, said two arm segments of said secondary winding disposed overlapping a portion of the planar ribbon segments of said primary winding, thereby forming sandwiched regions in which said primary winding and said secondary winding are interleaved; and e) installing a magnetic core having at least two magnetic core sections shaped to couple magnetic flux between said primary and said secondary winding, said magnetic core sections positioned to surround said sandwiched regions of said primary winding and said secondary winding, said magnetic core sections applying sufficient pressure to reduce the separation between said primary winding and said secondary winding in said sandwiched regions;

wherein said magnetic core sections selectively compress said sandwiched regions exclusive of said corner turns.

13. The method of claim 12 wherein the step of forming a secondary winding comprises the step of stamping a copper sheet into a U-shaped segment.

14. The method of claim 12 wherein the step of installing two magnetic core sections comprises the step of installing a double E-shaped magnetic core around the interleaved windings.

15. The method of claim 12 wherein the step of installing two magnetic core sections comprises the step of installing one E-shaped magnetic core and one rectangular shaped magnetic core around the interleaved windings.

16. The method of claim 12 further comprising the step of bringing the primary and secondary windings into close contact by applying pressure before the transformer core is installed.

17. The method of claim 12 wherein the step of providing a conductive foil ribbon coated in insulation comprises the step of coating a conductive foil ribbon with an insulator.

18. The method of claim 17 wherein the step of coating said conductive foil ribbon with an insulator comprises coating said foil ribbon in heat shrinkable tubing.

19. A method of fabricating a low profile electrical transformer comprising the steps of:

a) forming a primary winding from a first conductive foil ribbon coated with a continuous layer of insulation between first and second end regions, said primary winding formed by folding said first conductive foil ribbon a plurality of times by creasing said first foil ribbon at a forty-five degree angle with respect to the long axis of said first foil ribbon thereby forming a series of first folded corner turns connecting first planar ribbon segments, the primary winding forming a staircase-shaped structure rising up in steps along a common axis around a rectangular-shaped stairwell formed by the first planar ribbon segments;

b) forming a secondary winding by folding a second conductive foil ribbon, said second conductive foil ribbon coated with insulation, said secondary winding formed by folding said second conductive foil ribbon a plurality of times by creasing the foil ribbon at a forty-five degree angle with respect to the long axis of said second foil ribbon a plurality of times thereby forming a series of folded second corner turns connecting second planar ribbon segments, said secondary winding forming a staircase-shaped structure rising up in steps along a common axis around a rectangular-shaped stairwell formed by the second planar ribbon segments;

c) interleaving said primary winding with said secondary winding to form sandwich regions in which said first and said second planar ribbon segments overlap; and d) installing a magnetic core having at least two magnetic core sections shaped to surround said sandwich regions of said primary and said secondary windings, said magnetic core applying sufficient pressure to reduce the separation between said primary winding and said secondary winding in said sandwich regions;

wherein said magnetic core sections selectively compress said sandwich regions exclusive of said corner turns.

20. The method of claim 19 wherein the step of forming said secondary winding is performed simultaneously during the step of forming said primary winding by overlapping said second conductive foil ribbon substantially along the length of said first conductive foil ribbon prior to folding said first conductive ribbon.

* * * * *